US005423429A

United States Patent [19]

Hawthorne

[11] Patent Number: 5,423,429

[45] Date of Patent: Jun. 13, 1995

[54] APPARATUS AND PROCESS FOR SEPARATION OF PARTICULATE MATTER FROM AN AQUEOUS CARRIER

[75] Inventor: Namon A. Hawthorne, 3821 W. Covina, Mesa, Ariz. 85203

[73] Assignee: Namon A. Hawthorne, Independence, Kans.

[21] Appl. No.: 143,955

[22] Filed: Nov. 10, 1993

[51] Int. Cl.[6] ..... B03B 5/66

[52] U.S. Cl. ..... 209/156; 209/157; 209/210

[58] Field of Search ..... 209/155, 156, 157, 158, 209/159, 208, 210, 456, 459, 460

[56] References Cited

U.S. PATENT DOCUMENTS

| | | | |
|---|---|---|---|
| 1,432,766 | 10/1922 | Linden | 209/210 |
| 1,470,531 | 10/1923 | Hokanson | 209/156 |
| 2,590,756 | 3/1952 | Colin et al. | 209/156 X |
| 3,591,000 | 7/1971 | Humphreys | 209/157 X |
| 4,894,146 | 1/1990 | Giddings | 209/210 X |

FOREIGN PATENT DOCUMENTS

| | | | |
|---|---|---|---|
| 0012740 | 6/1980 | European Pat. Off. | 209/156 |
| 712891 | 8/1932 | France | 209/156 |
| 993092 | 10/1951 | France | 209/156 |
| 75385 | 8/1954 | Netherlands | 209/156 |
| 357489 | 3/1930 | United Kingdom | 209/156 |

*Primary Examiner*—D. Glenn Dayoan

*Attorney, Agent, or Firm*—Wilson, Sonsini, Goodrich & Rosati

[57] ABSTRACT

An apparatus provides the removal of particular matter from an aqueous carrier such as water, water-based slurry, mine slurry, or the like. Particles below 40 mesh in size can be separated from the aqueous carrier and concentrated with like particles according to their specific gravity and flow characteristics. A plurality of guides are provided for directing the aqueous carrier into different flow paths which are configured to take advantage of the force of gravity for diverting the aqueous carrier into a plurality of drop channels. The drop channels contain additional flow diversion guides for diverting a portion of the primary flow through a respective drop channel. As the aqueous carrier flows through the guides and into the drop channels by gravity, the diversionary flow paths tend to pull matter below a desired density out of a primary drop channel. This enables particulate matter to be separated from the aqueous carrier and to be concentrated at a selected density.

11 Claims, 6 Drawing Sheets

APPARATUS AND PROCESS FOR SEPARATION OF PARTICULATE MATTER FROM AN AQUEOUS CARRIER

BACKGROUND OF THE INVENTION

The field of the invention relates to an apparatus for separating and removing particles from an aqueous carrier, such as a slurry or the like. More particularly, the field of the invention relates to a device and process for separating and concentrating particles according to their specific gravity for use in mining or soil remediation projects, or the like.

Economical restoration of contaminated soils and water to an environmentally acceptable condition is becoming a critical problem in many industrialized areas throughout the world. Conventional methods of removing contaminants such as heavy metals and other pollutants from soils and water-based slurries are expensive and often require the expenditure of large amounts of energy.

Conventional methods of soil and water remediation which focus on removing contaminants from water-based slurries or slurry materials have the disadvantage of a limited ability to process large amounts of contaminated soils, mine tailings, or the like.

Conventional methods which depend upon the separation of contaminants such as heavy metals from a slurry by screening the particles have the disadvantage of being unable to screen particles which fall below approximately 40 mesh in size. Thus, most conventional methods which rely upon a screening process to remove contaminants from soils or particles from a water-based slurry are incapable of solving the problem of soil or water remediation. These methods leave most of the smaller sized contaminants such as particles of lead, arsenic or the like in the soil or water.

Therefore, it is apparent that what is needed is an apparatus for large-scale removal of contaminants such as heavy metals, from water, water-based slurries, contaminated soils or the like. Such a method of large scale restoration of contaminated soils or water-based slurries to an environmentally acceptable condition should ideally be capable of substantially removing all of the heavy metal particles or other contaminants which exist in particulate form from water, a water-based slurry at, or other aqueous carrier at extremely high volume.

What is also needed is an apparatus capable of such large scale removal of particulate contaminants without the need for consuming large amounts of energy to effect such removal.

It would also be desirable if such an apparatus could also be applied for processing of mine slurries at high volumes for removing and separating various particles of ores or other material targeted for processing.

What is also needed is an apparatus for high volume selection of targeted particles according to their specific gravity or other unique characteristics which enables the particles to be separated not only from the slurry material, but from other particles. Such an apparatus ideally would be capable of separating and concentrating like kinds of particles at high volumes.

A side cross sectional view of a conventional particle separator which begins to solve these problems, and which was designed by the inventor of the current invention, is illustrated in FIG. 1. Referring to FIG. 1, particulate matter suspended in an aqueous carrier such as a slurry for mining operations or the like is introduced through a reservoir tank 2. The aqueous carrier and particulate matter is pumped into the reservoir tank 2 at a rate sufficient to keep it full so that constant pressure and supply is provided to the particle separator. The aqueous carrier and particulate matter spread across a circular dispersion plate 4 and travel radially outward along a series of concentric, annular steps 6. Each step has a drop flow opening 8, providing a path to a drop channel 10 full of the aqueous carrier.

The rate of flow of the aqueous carrier decreases as it spreads out over consecutively larger concentric steps. Thus, the flow rate is highest over the innermost step 6'. Only the densest particulate matter, having the highest specific gravity, drops through the drop flow opening 8 of the innermost step 6'. At each subsequent step consecutively less dense particulate matter drops through the drop flow openings 8.

The vertical sides 12 of the steps 6 serve dual purposes. First, they allow the force of gravity to act upon the aqueous carrier and provide the impetus for flow. This is an advantage over other conventional methods since less energy is used by the system. The vertical sides 12 also act as mixing means. As particulate matter passes over the horizontal part of each step 6, it begins to settle. The vertical part 12 of each step 6 mixes the particulate matter back into the aqueous carrier, promoting suspension of the particulate matter and avoiding settling.

Originally the drop channels 10 contained aqueous carrier but no flow path was provided through the drop channels; they were static. This had the disadvantage of providing a low yield and a low rate of throughput. Yield is critical because it is important to remove all contaminants. Throughput is critical for particle separators to economically remediate huge volumes of soil or water. In order to increase throughput, the rate of flow through the particle separator must be increased. However, increasing the rate of flow decreases the yield since more particulate matter is carried over the drop flow openings 8 at each step 6 of the particle separator.

One approach to solve this problem is to allow some flow through the drop channels 10, and to recycle matter captured in selected drop channels which are most likely to contain matter of a desired density. The matter in the selected drop channels is sent back through the particle separator in a separate run. This system has the disadvantage of having to make separate, non-continuous runs through the particle separator which is extremely costly and labor intensive. Further, this conventional recycling system, while providing higher yield, also causes scatter. In a single run at a low flow rate, matter of a desired density will be highly concentrated in a single drop channel. When the matter is run through twice at a higher flow rate, yield increases, but the matter of a desired density spreads among several drop channels 10, instead of being highly concentrated in a single drop channel. Thus, the desired matter is more often mixed with matter of other densities, reducing concentration. This is a serious disadvantage both for removing contaminants and for removing valuable ores. For removing contaminants, such as lead, it is desirable that there be a heavy concentration so the contaminant can be disposed of economically at high concentrations in low volume containers. For valuable ores, such as gold, there must be a threshold concentration for economical recovery processing.

Thus, what is needed is an apparatus and process for improved particle separation with increased throughput, and very low scatter, capable of separating and concentrating particles smaller than 40 mesh, potentially down to 50 microns.

SUMMARY OF THE INVENTION

In order to overcome the above-discussed disadvantages of known methods of removal of particulate contaminants from an aqueous carrier such as water, water-based slurries, mine slurries, or the like, a first aspect of the present invention provides an apparatus for separating targeted particles below 40 mesh in size. The particles are not only separated from an aqueous carrier, but are concentrated with like particles according to their specific gravity and flow characteristics.

One aspect of the present invention provides at least one primary guide means defining a substantially planar flow path for an aqueous carrier of particulate matter. For multiple stages of particle separation, a plurality of primary guide means, each defining a substantially planar flow path for the aqueous carrier, and a plurality of mixing means for promoting the suspension of the particulate matter in the carrier may be provided. The plurality of guide means may be connected consecutively by interposing mixing means between the guide means, defining a primary flow path. The guide means and mixing means may be provided by concentric, annular steps or the like. The top surface of the steps provides the base of the primary guide means, and the vertical drop provides the mixing means. The aqueous carrier flows down the concentric steps in a radial primary flow path. Such a structure takes advantage of the force of gravity for driving the flow, as well as for mixing the particulate matter during each vertical drop.

Another aspect of the present invention, provides at least two drop channels for each primary guide means, a primary drop channel defining a drop flow path and a diversion drop channel. The primary drop channel is in fluid communication with the primary guide means, forming a drop flow opening. As the aqueous carrier flows over the primary guide means, the densest particulate matter falls through the drop flow opening due to flow and the force of gravity. The rate of flow decreases as the aqueous carrier spreads out over consecutive primary guide means, so less dense matter tends to enter each subsequent drop channel. However, at high levels of throughput, the rate of flow tends to scatter matter so some less dense matter ends up in drop channels meant for higher density matter.

Thus, another aspect of the present invention provides a means for removing less dense matter that improperly falls through a drop flow opening. A diversion guide means defines a flow path between the primary drop channel and the diversion drop channel. The diversion guide means and the diversion drop channel together define a diversion flow path. The diversion flow path tends to pull matter below a desired density out of the primary drop channel. Thus, it is an advantage of this and other aspects of the present invention that the particulate matter in the primary drop channel tends to be highly concentrated at a selected density, despite a high flow rate along the primary flow path. Additional diversion guides and diversion drop channels may be added along the primary drop channel to select out matter of varying densities.

Another aspect of the present invention provides adjusting means for adjusting the rate of flow for each drop channel. The rate of flow through drop channels can be adjusted independently of the rate of flow through the primary flow path. It is an advantage of this and other aspects of the present invention that the flow rate through the primary and diversion drop channels can be adjusted to be highly sensitive to varying densities, while the primary flow path throughput remains high.

Another aspect of the present invention provides for selectively recycling the particulate matter captured in the diversion drop channels. It is an advantage of this aspect of the present invention that yield may be increased without scattering the concentrated material captured in the primary drop channel. It is an additional advantage of the present invention that the particulate matter to be recycled may be mixed with raw aqueous carrier ready for processing. The matter to be recycled need not be run through in a separate batch, and processing may proceed continuously.

Thus, the present invention enables low yield ores or contaminated soils to be processed at high volumes for the removal of targeted minerals or heavy metal contaminants.

A particle separator constructed in accordance with an aspect of the present invention is adapted to be capable of processing anywhere from approximately five tons per hour of 20% slurry to over 400 tons per hour of 20% slurry. An apparatus according to the present invention is believed capable of liberating certain targeted elements or compounds below 40 mesh, and potentially down to 50 microns, in size and concentrating those targeted elements or compounds together by reason of their specific gravity.

Accordingly, a primary application of the present invention is in the removal and separation of suspended contaminant materials, such as metals, from natural water sources (e.g., wells, streams, lakes, and the like). The present invention is also capable of selectively removing and separating targeted compounds from aqueous carriers such as prepared slurries of crushed mining ores, river bed silt, gravel bed washings, contaminated soils, or the like. This aspect of the present invention also enables precious metals such as gold, silver, rhodium, or the like to be selectively removed from prepared aqueous carriers and concentrated separately from one another due to their different specific gravities. Bulk materials such as mine ores or other value-containing materials are crushed to a minimum size, mixed in water to form a slurry and processed through an apparatus according to the present invention. In a present embodiment, at least 15 different particle types which have unique flow and density characteristics are capable of being separated and concentrated simultaneously.

When water alone is passed through an apparatus according to the invention, the exiting water has been found to be substantially free of suspended particles.

BRIEF DESCRIPTION OF THE DRAWINGS

These and other advantages of the present invention may be appreciated from studying the following detailed description of the presently preferred exemplary embodiment together with drawings in which.

DETAILED DESCRIPTION OF THE PRESENTLY PREFERRED EXEMPLARY EMBODIMENT

Figure 2:
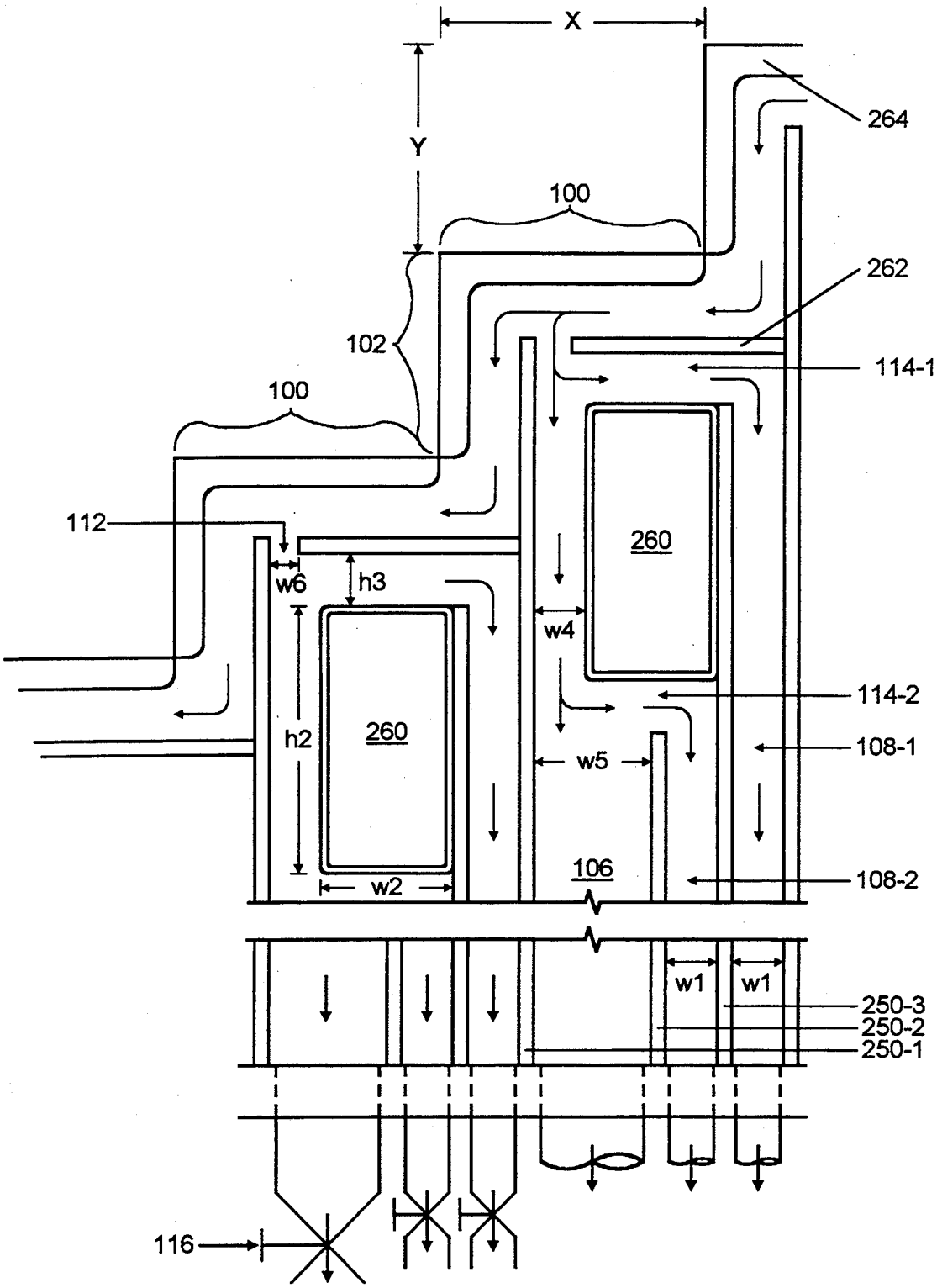
FIG. 2 is a cross sectional side view of a first embodiment according to the present invention.

Referring to FIG. 2, the apparatus according to the present invention provides at least one primary guide means 100 for defining a substantially planar flow path for an aqueous carrier of particulate matter. In the presently preferred embodiment, the planar flow path is defined substantially orthogonally to the direction of a separation force, such as gravity or the like, acting upon the particulate matter.

Figure 3:
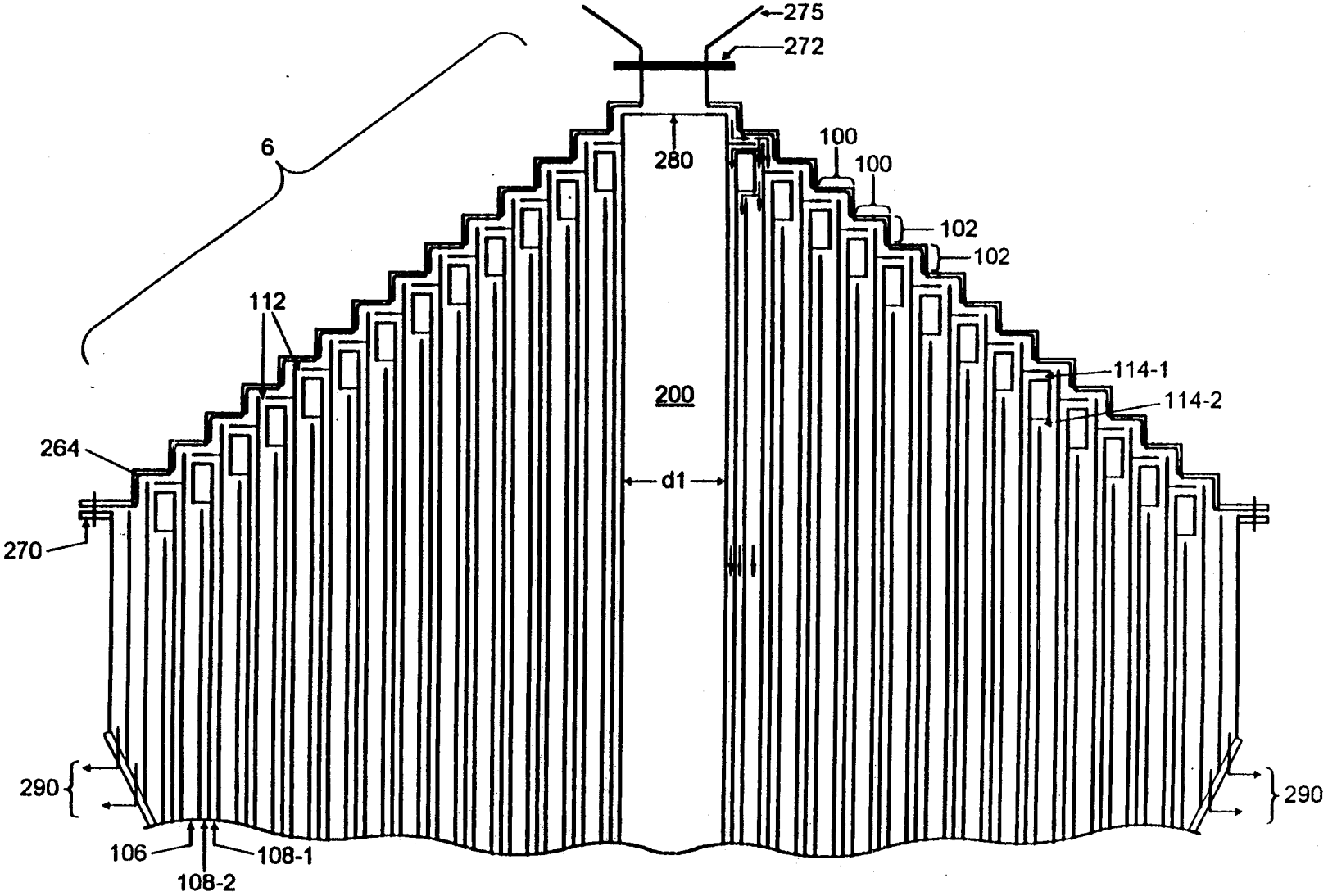
FIG. 3 is an enlarged cross sectional side view of the second embodiment of FIG. 2.

Referring to FIG. 3, for multiple stages of particle separation there are a plurality of primary guide means 100 each defining a substantially planar flow path for the aqueous carrier, and a plurality of mixing means 102 for promoting the suspension of the particulate matter in the carrier. The plurality of guide means 100 may be connected consecutively by interposing the mixing means 102 between the guide means, thereby defining a primary flow path. The primary guide means 100 and mixing means 102 may be provided by stepped tubes or the like made out of any variety of materials capable of confining and supporting the aqueous carrier at a desired pressure, including steel, various composites or the like. The top, flat surface of the steps provides the: bottom of the primary guide means 100, and the vertical drop provides the mixing means 102. By using a vertical drop, the force of gravity can be used to promote the flow of the aqueous liquid. Further the vertical drop promotes the mixture of the particulate matter in the carrier to prevent the matter from settling.

It will be realized by those skilled in the art that a variety of other structures may be used such as channels, tubes or the like. Mixing means may be provided by loops, pumps, shaking devices or the like. Additionally, mixing means may not be required between each primary guide means or for all types of particulate matter.

Figure 4:
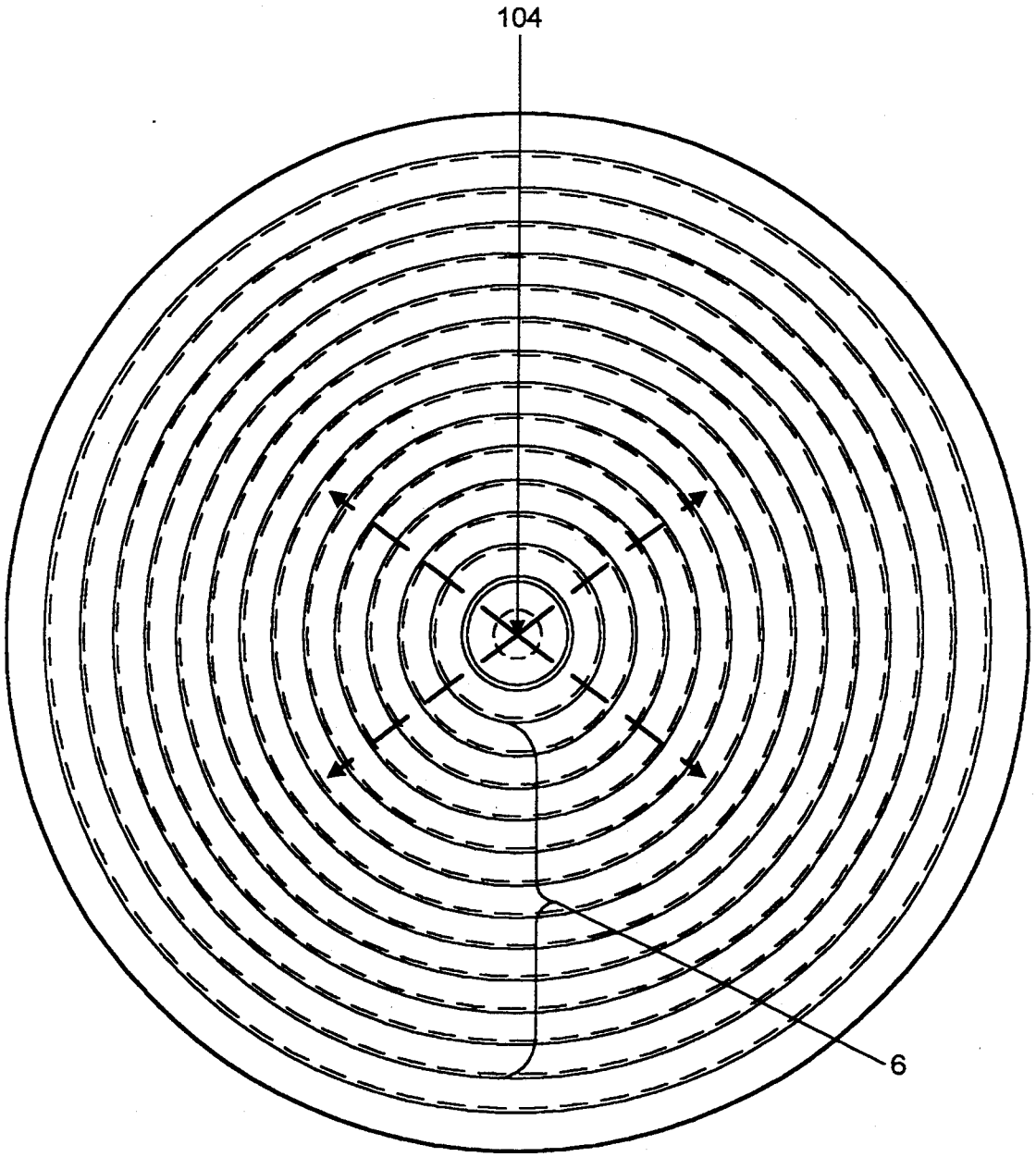
FIG. 4 is a top view of a second embodiment according to the present invention.

Referring to FIG. 4, a top view of the second embodiment, a series of concentric, annular steps 6 may be used to provide the primary guide means 100 and mixing means 102. In the presently preferred embodiment, the primary guide means 100 and the mixing means 102 define a primary flow path extending radially outward from the center 104 of the particle separator, which is the point of entry for the aqueous carrier and particulate matter. The aqueous carrier combined with particulate matter is provided at the center 104 of the concentric steps 6. The aqueous carrier then flows down the concentric steps 6 in a primary flow path. While other geometries may be used, a circular stepped path provides for even radial flow in all directions, and reduces eddying which inhibits particle separation. Further, such a structure takes advantage of the force of gravity for driving the flow, as well as for mixing the particulate matter during each vertical drop.

Referring to FIG. 2, at least two drop channels are provided for each primary guide means, a primary drop channel 106 defining a drop flow path and at least one diversion drop channel, 108-1 and 108-2. The primary drop channel 106 is in fluid communication with the primary guide means 100, forming a drop flow opening 112. In the presently preferred embodiment, the drop channels are substantially orthogonal to the planar flow path defined by the primary guide means. Thus, the drop channels provide flow paths in the direction of a separation force, such as gravity or the like, acting upon the particulate matter.

As the aqueous carrier flows through the primary guide means 100, particulate matter above a certain threshold density tends to fall through the drop flow opening 112. The rate of flow decreases as the aqueous carrier spreads over consecutive primary guide means, so there is a lower threshold density level for each subsequent primary guide means 100. Thus, less dense material tends to enter each subsequent drop channel 112.

However, some matter below the threshold density for a particular primary guide means 100 may fall through the drop flow opening 112. It is desirable that this matter be separated. Thus, the first embodiment provides at least one diversion guide means, 114-1 and 114-2, for providing a flow path between the primary drop channel 106 and the diversion drop channel, 108-1 and 108-2. In the presently preferred embodiment this flow path diverges substantially orthogonally from the drop flow path, and is substantially orthogonal to the direction of the separation force.

Figure 1:
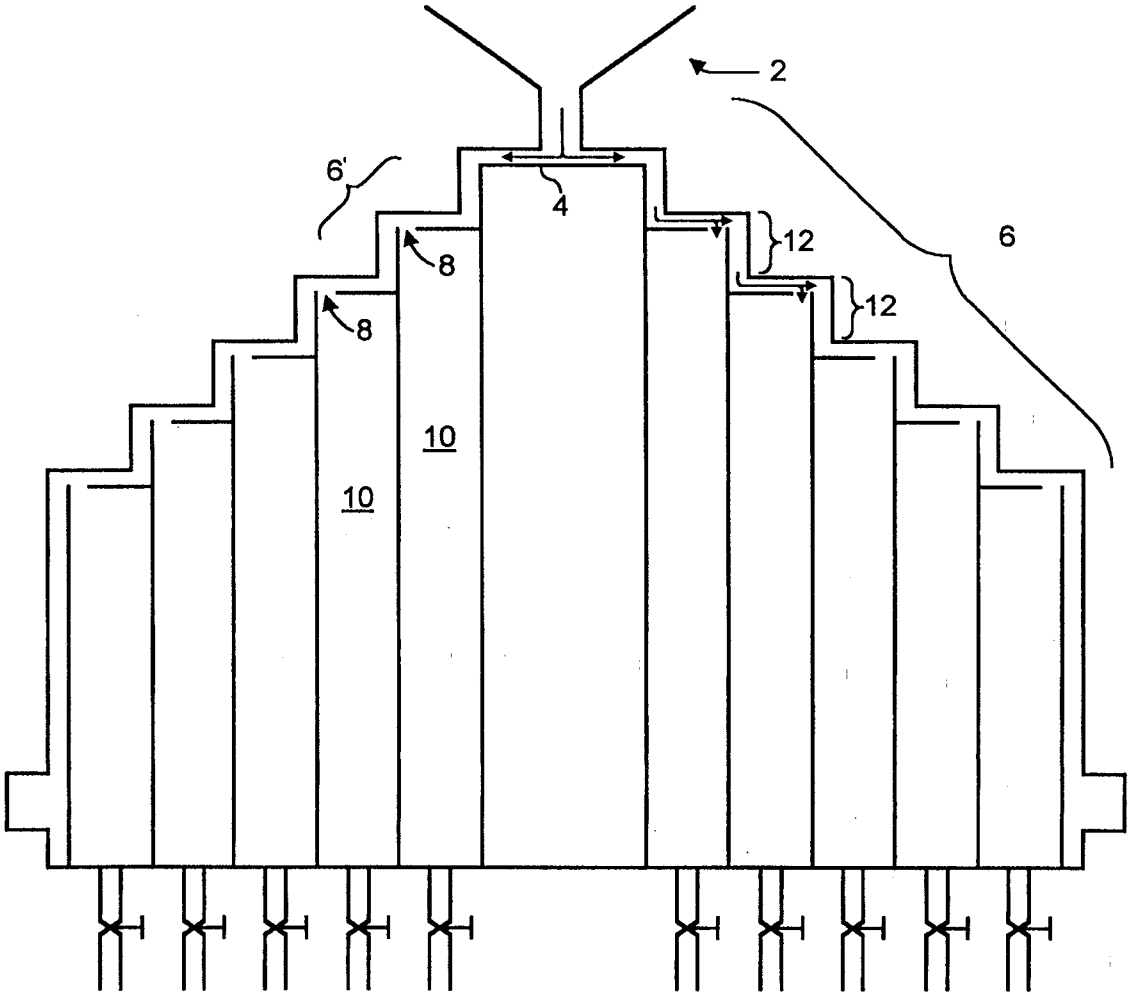
Prior Art Figure 1
FIG. 1 illustrates an example of a known conventional particle separator.
Figure 5:
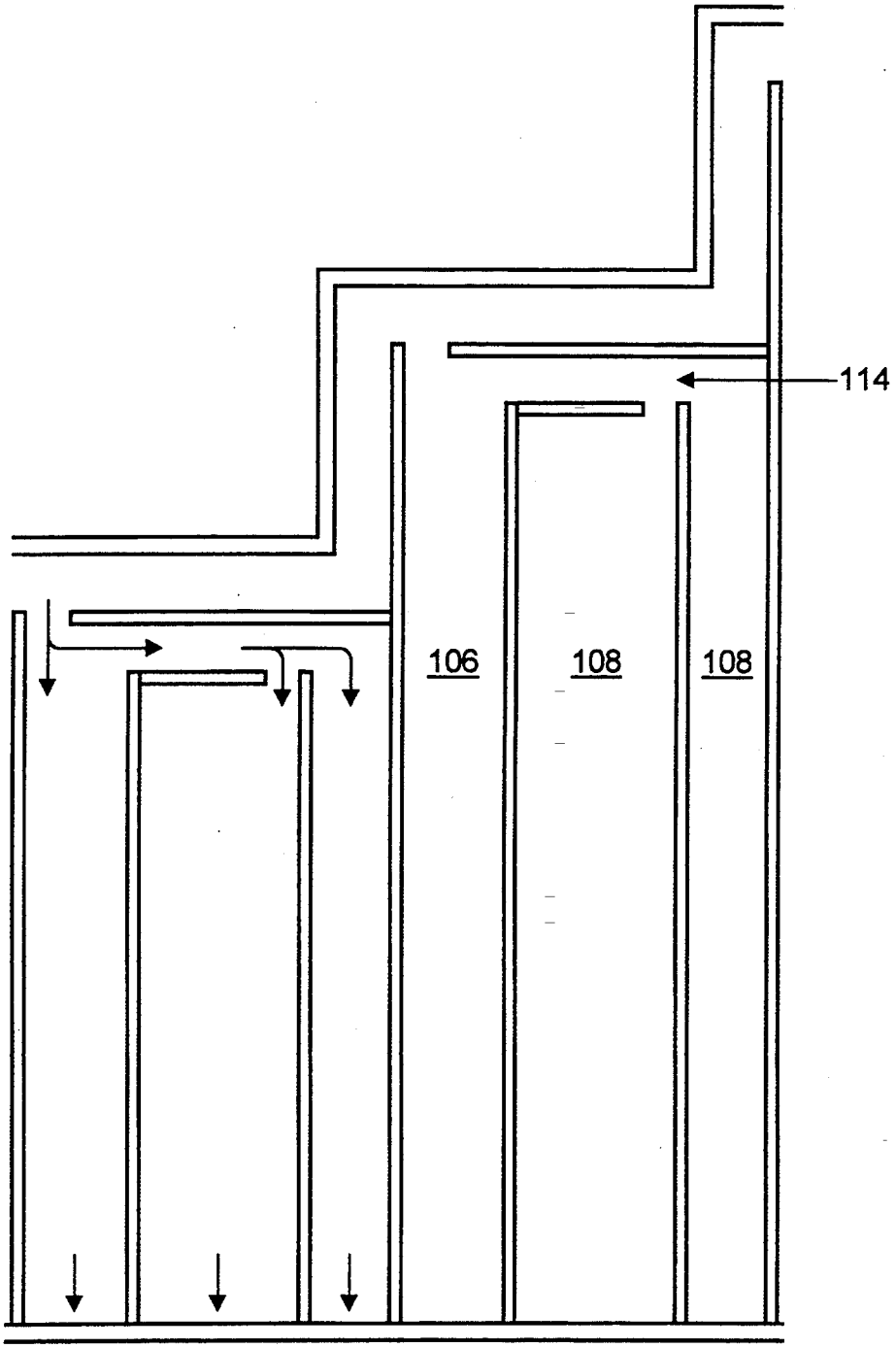
FIG. 5 is a cross sectional side view of an aspect of the present invention.

The diversion guide means 114-1 and 114-2 and the diversion drop channel 108-1 and 108-2 define a diversion flow path. The diversion flow path pulls lower density matter out of the primary drop channel 106. Additional diversion guides and drop channels may be added along the primary drop channel to select out matter of varying densities. In FIG. 1, the diversion flow path defined by diversion guide means 114-1 and diversion drop channel 108-1 pulls out the matter of the lowest density. The diversion flow path defined by diversion guide means 114-2 and diversion drop channel 108-2 pulls out matter of a slightly higher density since it is connected further down the primary drop channel 106. The denser matter, above a certain threshold density, remains in the primary drop channel 106. Alternatively as shown in FIG. 5, several diversion drop channels 108 may derive from a single diversion guide means 114. This arrangement, however, is more likely to present problems of eddying and settling.

Thus, the drop channels, diversion guide means, drop flow path and diversion flow path comprise a drop system for each primary guide means. The aqueous carrier and the particulate matter flow along the primary flow path. For each primary guide means and drop system, the carrier divides into first, second and third portions. The first portion continues along the primary flow path. The second and third portions flow along the drop and diversion flow paths respectively. The particulate matter is divided among the partitions substantially by density. Each primary guide means has a threshold density. The threshold density decreases with the rate of flow through consecutive primary guide means. A majority of matter above the threshold density for each primary guide means flows along the drop flow path. A majority of matter below the threshold density continues along the primary flow path, and a minority of matter both above and below the threshold density flows along the diversion flow path. Thus, particulate matter is substantially separated and concentrated according to density.

Referring to FIG. 2, adjusting means 116 for adjusting the rate of flow for each drop channel 106, 108-1 and 108-2 may be provided, such as valves or the like. The rate of flow through the drop channels may also be controlled through varying the width of the drop channels at the point of exit. The rate of flow through the drop channels can be adjusted independently of the rate of flow through the primary flow path. The flow rate through the drop channels can be adjusted to be highly sensitive to varying densities, while the primary flow path throughput remains high. The higher the rate of flow through any particular drop channel, the more matter of a higher density will be captured by the drop flow channel.

A variety of designs, materials, and dimensions may be used to construct a particle separator within the scope of the present invention. What is important is that the particulate matter be substantially suspended in the aqueous carrier, which together are caused to flow across the drop flow openings. A flow and a separation force correlated to density, such as gravity, cause the denser matter to enter the primary drop channel. At least one diversion flow path then draws off less dense material that inadvertently enters the primary drop channel.

The presently preferred embodiment, as described above, however, specifically uses concentric, annular steps 6 to define a radial primary flow path. Referring to FIG. 3, such an embodiment may be constructed around a cylindrical core dry tank 200 that acts as a support, and may weigh as much as 45,000 pounds. The core dry tank has a diameter d1 of approximately 12 inches, and a height, orthogonal to the diameter, of approximately 14 feet, 4¾ inches. Of course, one skilled in the art will realize that the dimensions may be readily changed to accommodate different sized particle separators or particulate matter.

Referring to FIG. 2, the drop channels are formed, in part, by cylindrical walls 250-1, 250-2, and 250-3 encircling the core dry tank. The cylindrical walls are made of rigid material, such as steel or the like, approximately 3/16 of an inch thick. Each diversion drop channel, 108-1 and 108-2, has a width w1 of approximately 1 inch. The diversion guide means, 114-1 and 114-2, for each diversion channel are provided in part by closed annular tanks 260, having a height h2 of approximately 4 inches and a width w2 of approximately 2 inches. These annular tanks 260 provide the bottom of the diversion guide means 114-1, and the top of diversion guide means 114-2. Each diversion guide means, 114-1 and 114-2, has a height h3 of approximately ¾ inch. The primary drop channel 106 has a width w4 of approximately 13/16 inch in the area adjacent to the annular tank 260, and a width w5 of approximately 1 13/16 inches below the annular tank 260.

Annular weir plates 262, approximately 3/16 inch thick, are attached approximately ¾ inch above the annular tanks 260. The weir plates provide a top for the diversion guide means 114-1, and a bottom for the primary guide means 100. The weir plates 262 and the circular wall 250-1 of the primary drop channel 106 define the drop flow opening 112, having a width w6 of approximately ½ inch.

To prevent warping, maintain dimensions, and provide support, ¾ inch spacers or brackets are provided and placed periodically in each diversion guide means. The spacers are dispersed as needed for support throughout the particle separator. The spacers connect the cylindrical walls 250-1, 250-2 and 250-3, the annular dry tanks 260, and the weir plates 262, as needed to provide structural integrity.

A stepped lid 264, approximately ⅜ inch thick, is placed approximately ¾ inch over the weir plates 262, each step of the lid having a run x and a rise y. Each run x being about 4 inches and each rise y being about 3 inches.

The run x of each step of the lid 264 provides a top for the primary guide means 100. The rise y of each step of the lid 264 and a top portion of the cylindrical wall 250-1 provide the mixing means 102.

Thus, the stepped lid 264, the weir plates 262, and a top portion of the cylindrical wall 250-1 define the primary flow path.

Referring to FIG. 3, the stepped lid 264 is bolted to an outer lip 270 around the outer circumference of the particle separator, as well as to an inner lip 272 around a supply means 275 in the center of the particle separator to hold the lid in place. Gaskets are used to provide a seal at these points.

Referring to FIG. 2, the bottom of the drop channels 106, 108-1, 108-2 form a plurality of funnels feeding hoses to collect the aqueous carrier and particulate matter from the drop channels. Adjusting means 116, such as valves or the like, for adjusting the rate of flow through the drop channels are attached to the hoses or the funnels. The adjusting means may also act as a shut off means for stopping flow through the drop channels. Alternatively, a separate shut off means, such as a second set of valves, may be used so the settings of the adjusting means may be preserved for future use, while the particle separator is shut off.

Referring to FIG. 3, in operation, aqueous carrier with particulate matter is supplied through a supply means 275 to provide a constant pressure and supply of aqueous carrier to the particle separator. In the presently preferred embodiment the supply means is a reservoir tank but may be a pump or other means providing sufficient pressure. In the presently preferred exemplary embodiment the aqueous carrier is optimally filtered at 40 mesh before processing. Those skilled in the art will readily understand that larger particle separators can be designed to optimally separate particles larger than 40 mesh. The size of the reservoir tank or other supply means may also be varied to adjust the pressure and velocity of the supply.

In the presently preferred embodiment, the top 280 of the core tank 200 acts as a dispersion plate for the aqueous carrier entering from the supply means 275, sending the aqueous carrier of particulate matter flowing radially outward along the primary flow path.

At start up, the shut off means are set to prevent flow through the drop channels. The aqueous carrier is pumped to the supply means at a rate sufficient to keep it full and provide a constant flow through the primary flow path and out exhaust pipes 290.

Then the shut off means are set to allow flow through the drop channels. The adjusting means of the primary drop channels are set to allow a flow of approximately 20–25 gallons/minute. The adjusting means of the diversion drop channels are set to allow flow of approximately 15 gallons/minute. There settings should allow about half of the overall volume to flow through the drop channels. The rate of flow through the drop channels is then fine-tuned to optimize for separation of particulate matter of a desired density. The greater the rate of flow through any particular drop channel, the more matter of a higher density that will be captured by the drop channel.

The presently preferred embodiment, substantially as described, will have an intake volume of approximately 1,800 gallons/minute. This is approximated based on a four foot per second flow rate for an aqueous carrier with about 20 percent particulate matter (20% slurry). The consistency, viscosity and percent particulate matter in the carrier may vary the flow drastically for any specific run.

Another aspect of the present invention provides for selectively recycling the particulate matter captured in the diversion drop channels 108-1 and 108-2. Yield may be increased without scattering the concentrated material captured in the primary drop channel 106.

Figure 6:
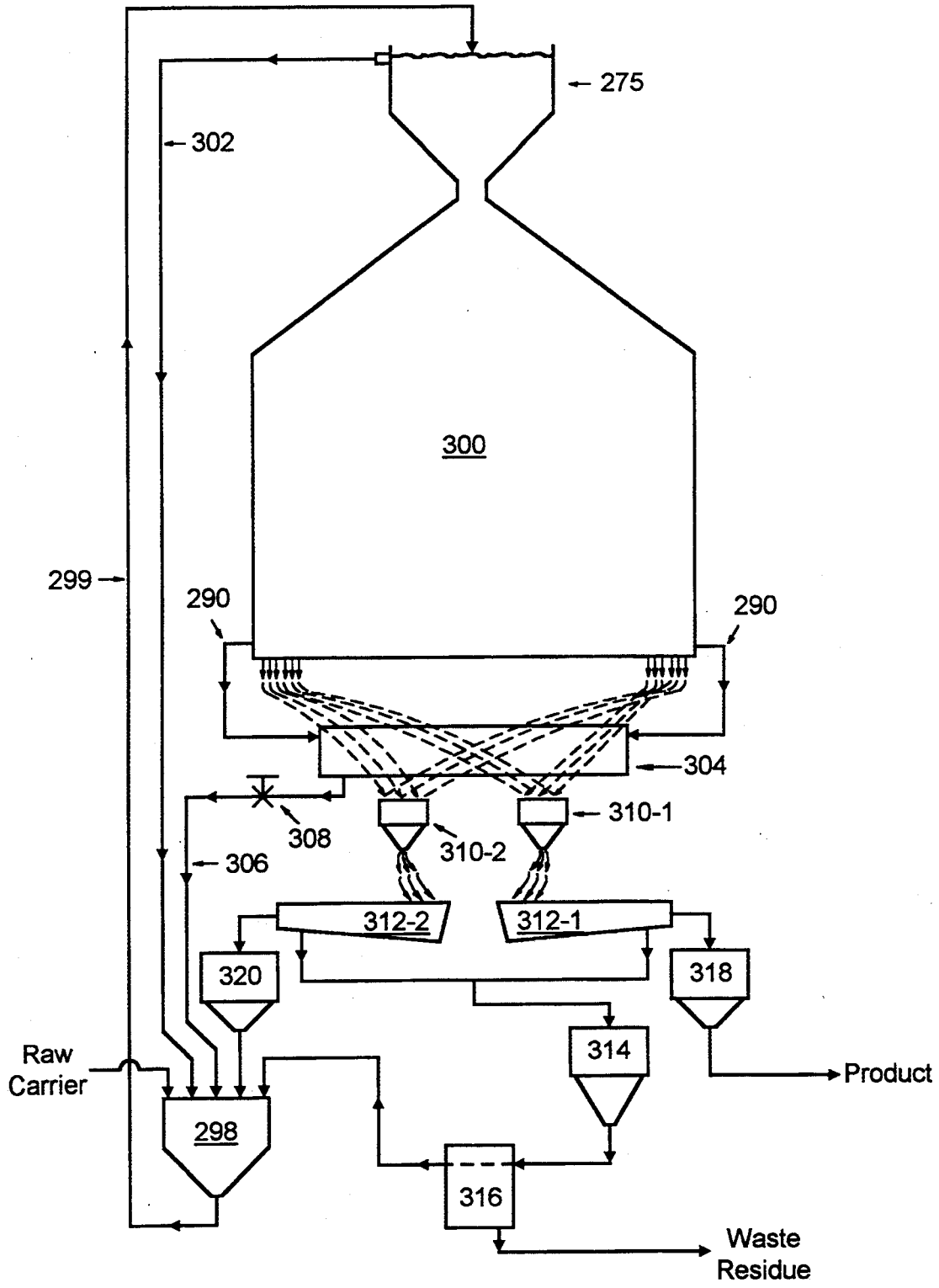
FIG. 6 illustrates a process according to the present invention for recycling material through a particle separator.

Referring to FIG. 6, raw carrier such as slurry or the like is introduced to primary supply tank 298. The aqueous carrier and particulate matter is then pumped up supply line 299 to the supply means 275. The raw aqueous carrier is pumped at a rate sufficient to keep the supply means barely overflowing. This provides constant supply and pressure to the particle separator 300. Raw aqueous carrier overflowing from the supply means 275 is pumped back into the primary supply tank 298 via overflow line 302. Raw aqueous carrier in the supply means 275 is introduced into a particle separator 300 according to the present invention.

Aqueous carrier that travels along the primary flow path of the particle separator 300 and is not diverted into any drop channels exits via exhaust pipes 290. This processed aqueous carrier is substantially free of suspended particulate matter and is fed into ballast means 304. The ballast means provides a ballast for the primary flow path and helps regulate the rate of flow through the particle separator 300. The ballast means may be a tank or the like. The processed aqueous carrier in the ballast means 304 is fed back to the primary supply tank 298 to be reused. It is fed through exhaust line 306 and the rate of flow through the exhaust line is controlled by exhaust valve 308.

Aqueous carrier and particulate matter that is captured by the drop channels is funneled to drop bins 310-1 and 310-2 via tubes or the like. Particulate matter of a desired density from the primary drop channels is funneled to drop bin 310-1. Particulate matter captured by the diversion drop channels is funneled to drop bin 310-2. The aqueous carrier and particulate matter in the drop bins is then processed through conventional sandscrew tanks 312-1 and 312-2 or like filter means for separating the particulate matter from the aqueous carrier. The processed aqueous carrier and any light residue is funneled to thickener tank 314. A thickener may optionally be added to thickener tank 314 to promote coagulation of undesirable residues such as clays and the like. The processed aqueous carrier and thickened residue is then passed through a filter means 316 for separating the residue and the aqueous carrier. The filter means may be any of many conventional filter means such as a drum filter or the like. Waste residue from filter 316 is then discarded. Processed aqueous carrier from filter means 316 is substantially free of residue and is recycled back into primary supply tank 298.

The sandscrew tank 312-1 provides particulate matter of the desired density to product bin 318. This particulate matter is highly concentrated according to density and can be removed from the system as the desired product.

Particulate matter from sandscrew tank 312-2 or a like filter means is provided to product bin 320. This particulate matter was captured by the diversion channels and is a mix of varying densities. This matter may contain some particulate matter of the desired density and will be rerun through the system so that this desired matter may be harvested. Thus, the particulate matter in product bin 320 may be fed back into primary supply tank 298. This matter does not need to be run separately through the particle separator. Thus, raw carrier and recycled particulate matter may be processed continually.

While the invention has been described in connection with what is presently considered to be the most practical and preferred embodiments, it is to be understood that the invention is not limited to disclosed embodiments, but, on the contrary, is intended to cover various modifications and equivalent arrangements. For example, steps need not be used to provide the primary flow path. A planar channel with a pump may be used to provide the planar flow path. In addition, dimensions may be altered drastically to scale or optimize the particle separator for different volumes and different sized particulate matter. Also, various conventional filter means and collection systems may be substituted into the recycling process without substantial change. Therefore, persons of ordinary skill in this field are to understand that all such equivalent arrangements are to be included in the spirit and scope of the appended claims.

What is claimed is:

1. A particle separator for removing particulate matter of varying density from an aqueous carrier, comprising:

at least one primary guide means for defining a substantially planar flow path;

a primary drop channel defining a drop flow path; a diversion drop channel comprising at least one diversion guide means for defining a flow path diverging from the drop flow path, and extending from the primary drop channel to the diversion drop channel; and wherein the primary guide means and the primary drop channel are in fluid communication and provide at least one drop flow opening; and the diversion guide means and the diversion drop channel define a diversion flow path such that the aqueous carrier and the particulate matter flow along the primary flow path and divide into first, second, and third portions flowing along the primary, drop and diversion flow paths, respectively; and the particulate matter in the first, second and third portions is selected substantially according to the density of the particulate matter;

wherein said at least one diversion guide means defines the flow path diverging from the drop flow path substantially orthogonally to a direction of a separation force acting upon the particulate matter.

2. A particle separator for removing particulate matter of varying density from an aqueous carrier, comprising:

at least one primary guide means for defining a substantially planar flow path;

a primary drop channel defining a drop flow path; a diversion drop channel comprising at least one diversion guide means for defining a flow path diverging from the drop flow path, and extending from the primary drop channel to the diversion drop channel; and wherein the primary guide means and the primary drop channel are in fluid communication and provide at least one drop flow opening; and the diversion guide means and the diversion drop channel define a diversion flow path such that the aqueous carrier and the particulate matter flow along the primary flow path and divide into first, second, and third portions flowing along the primary, drop and diversion flow paths, respectively; and the particulate matter in the first, second and third portions is selected substantially according to the density of the particulate matter;

wherein said at least one diversion guide means defines the flow path diverging from the drop flow path substantially orthogonally to said drop flow path.

3. A particle separator for removing particulate matter of varying density from an aqueous carrier, comprising:

at least one primary guide means for defining a substantially planar flow path;

a primary drop channel defining a drop flow path; a diversion drop channel comprising at least one diversion guide means for defining a flow path diverging from the drop flow path, and extending from the primary drop channel to the diversion drop channel; and wherein the primary guide means and the primary drop channel are in fluid communication and provide at least one drop flow opening; and the diversion guide means and the diversion drop channel define a diversion flow path such that the aqueous carrier and the particulate matter flow along the primary flow path and divide into first, second, and third portions flowing along the primary, drop and diversion flow paths, respectively; and the particulate matter in the first, second and third portions is selected substantially according to the density of the particulate matter; wherein said at least one diversion guide means defines the flow path diverging from the drop flow path substantially orthogonally to a direction of a separation force acting upon the particulate matter; and wherein said separation force is gravity.

4. A particle separator for removing particulate matter of varying density from an aqueous carrier, comprising:

at least one primary guide means for defining a substantially planar flow path;

a primary drop channel defining a drop flow path; a diversion drop channel comprising at least one diversion guide means for defining a flow path diverging from the drop flow path, and extending from the primary drop channel to the diversion drop channel; and wherein the primary guide means and the primary drop channel are in fluid communication and provide at least one drop flow opening; and the diversion guide means and the diversion drop channel define a diversion flow path such that the aqueous carrier and the particulate matter flow along the primary flow path and divide into first, second, and third portions flowing along the primary, drop and diversion flow paths, respectively; and the particulate matter in the first, second and third portions is selected substantially according to the density of the particulate matter, and wherein a majority of the particulate matter above a threshold density tends to be carried along the drop flow path; and a majority of the particulate matter below the threshold density tends to be carried along the primary flow path; and a minority of the particulate matter both above and below the threshold density tends to be carried along the diversion flow path;

whereby the particulate matter is substantially separated and concentrated according to density; and wherein said at least one primary guide means defines the primary flow path substantially orthogonally to a direction of a separation force acting upon the particulate matter;

said primary drop channel and said diversion drop channel each define a flow path substantially in the direction of the separation force acting upon the particulate matter; and said at least one diversion guide means defines the flow path diverging from the drop flow path substantially orthogonally to the direction of the separation force acting upon the particulate matter.

5. A particle separator for removing particulate matter of varying density from an aqueous carrier, comprising:

a plurality of primary guide means each defining a substantially planar flow path;

at least one mixing means for promoting the suspension of the particulate matter in the aqueous carrier;

the plurality of primary guide means connected consecutively in fluid communication by the at least one mixing means interposed between the primary guide means, defining a primary flow path;

each primary guide means being in fluid communication with at least one respective drop system forming a drop flow opening, each respective drop system including:

(a) at least two drop channels, a primary drop channel defining a drop flow path and a diversion drop channel; the primary drop channel being in fluid communication with the primary flow path via the drop flow opening;.

(b) at least one diversion guide means for defining a flow path diverging from the drop flow path, and extending from the primary drop channel to the diversion drop channel, the diversion guide means and the diversion drop channel defining a diversion flow path;

the aqueous carrier and the particulate matter flowing along the primary flow path and for each primary guide means and respective drop system:

dividing into first, second, and third portions; the first portion continuing to flow along the primary flow path; the second and third portions flowing along the drop and diversion flow paths, respectively, of the respective drop system; the particulate matter in the first, second, and third portions being selected substantially according to the density of the particulate matter; and wherein in each drop system, said at least one diversion guide means defines the flow path diverging from the drop flow path substantially orthogonally to a direction of a separation force acting upon the particulate matter.

6. A particle separator for removing particulate matter of varying density from an aqueous carrier, comprising:

a plurality of primary guide means each defining a substantially planar flow path;

at least one mixing means for promoting the suspension of the particulate matter in the aqueous carrier;

the plurality of primary guide means connected consecutively in fluid communication by the at least one mixing means interposed between the primary guide means, defining a primary flow path;

each primary guide means being in fluid communication with at least one respective drop system forming a drop flow opening, each respective drop system including:

(a) at least two drop channels, a primary drop channel defining a drop flow path and a diversion drop channel; the primary drop channel being in fluid communication with the primary flow path via the drop flow opening;

(b) at least one diversion guide means for defining a flow path diverging from the drop flow path, and extending from the primary drop channel to the diversion drop channel, the diversion guide means and the diversion drop channel defining a diversion flow path;

the aqueous carrier and the particulate matter flowing along the primary flow path and for each primary guide means and respective drop system:

dividing into first, second, and third portions; the first portion continuing to flow along the primary flow path; the second and third portions flowing along the drop and diversion flow paths, respectively, of the respective drop system; the particulate matter in the first, second, and third portions being selected substantially according to the density of the particulate matter; and wherein in each drop system said at least one diversion guide means defines the flow path diverging from the drop flow path substantially orthogonally to said drop flow path.

7. A particle separator for removing particulate matter of varying density from an aqueous carrier, comprising:

a plurality of primary guide means each defining a substantially planar flow path;

at least one mixing means for promoting the suspension of the particulate matter in the aqueous carrier;

the plurality of primary guide means connected consecutively in fluid communication by the at least one mixing means interposed between the primary guide means, defining a primary flow path;

each primary guide means being in fluid communication with at least one respective drop system forming a drop flow opening, each respective drop system including:

(a) at least two drop channels, a primary drop channel defining a drop flow path and a diversion drop channel; the primary drop channel being in fluid communication with the primary flow path via the drop flow opening;

(b) at least one diversion guide means for defining a flow path diverging from the drop flow path, and extending from the primary drop channel to the diversion drop. channel, the diversion guide means and the diversion drop channel defining a diversion flow path;

the aqueous carrier and the particulate matter flowing along the primary flow path and for each primary guide means and respective drop system:

dividing into first, second, and third portions; the first portion continuing to flow along the primary flow path; the second and third portions flowing along the drop and diversion flow paths, respectively, of the respective drop system; the particulate matter in the first, second, and third portions being selected substantially according to the density of the particulate matter; and wherein the primary guide means and mixing means are provided by a plurality of concentric, annular steps.

8. A particle separator for removing particulate matter of varying density from an aqueous carrier, comprising:

a plurality of primary guide means each defining a substantially planar flow path;

at least one mixing means for promoting the suspension of the particulate matter in the aqueous carrier;

the plurality of primary guide means connected consecutively in fluid communication by the at least one mixing means interposed between the primary guide means, defining a primary flow path;

each primary guide means being in fluid communication with at least one respective drop system forming a drop flow opening, each respective drop system including:

(a) at least two drop channels, a primary drop channel defining a drop flow path and a diversion drop channel; the primary drop channel being in fluid communication with the primary flow path via the drop flow opening;

(b) at least one diversion guide means for defining a flow path diverging from the drop flow path, and extending from the primary drop channel to the diversion drop channel, the diversion guide means and the diversion drop channel defining a diversion flow path;

the aqueous carrier and the particulate matter flowing along the primary flow path and for each primary guide means and respective drop system:

dividing into first, second, and third portions; the first portion continuing to flow along the primary flow path; the second and third portions flowing along the drop and diversion flow paths, respectively, of the respective drop system; the particulate matter in the first, second, and third portions being selected substantially according to the density of the particulate matter; and wherein in each drop system, said at least one diversion guide means defines the flow path diverging from the drop flow path substantially orthogonally to a direction of a separation force acting upon the particulate matter; and wherein said separation force is gravity.

9. A particle separator for removing particulate matter of varying density from an aqueous carrier, comprising:

a plurality of primary guide means each defining a substantially planar flow path;

at least one mixing means for promoting the suspension of the particulate matter in the aqueous carrier;

the plurality of primary guide means connected consecutively in fluid communication by the at least one mixing means interposed between the primary guide means, defining a primary flow path;

each primary guide means being in fluid communication with at least one respective drop system forming a drop flow opening, each respective drop system including:

(a) at least two drop channels, a primary drop channel defining a drop flow path and a diversion drop channel; the primary drop channel being in fluid communication with the primary flow path via the drop flow opening;

(b) at least one diversion guide means for defining a flow path diverging from the drop flow path, and extending from the primary drop channel to the diversion drop channel, the diversion guide means and the diversion drop channel defining a diversion flow path;

the aqueous carrier and the particulate matter flowing along the primary flow path and for each primary guide means and respective drop system:

dividing into first, second, and third portions; the first portion continuing to flow along the primary flow path; the second and third portions flowing along the drop and diversion flow paths, respectively, of the respective drop system; the particulate matter in the first, second, and third portions being selected substantially according to the density of the particulate matter;

wherein each primary guide means is associated with a consecutively decreasing respective threshold density; and for each primary guide means and respective drop system:

(a) a majority of the particulate matter above the respective threshold density tends to be carried along the drop flow path of the respective drop system; and (b) a majority of the particulate matter below the respective threshold density tends to continue along the primary flow path; and a minority of the particulate matter both above and below the respective threshold density tends to be carried along the diversion flow path of the respective drop system;

whereby the particulate matter is substantially separated and concentrated according to density; and wherein said at least one primary guide means defines the planar flow path substantially orthogonally to a direction of a separation force acting upon the particulate matter; and wherein in each drop system said at least two drop channels define a flow path substantially in the direction of the separation force acting upon the particulate matter, and said at least one diversion guide means defines the flow path diverging from the drop flow path substantially orthogonally to the direction of the separation force acting upon the particulate matter.

10. A particle separator for removing particulate matter of varying density from an aqueous carrier, comprising:

a plurality of primary guide means each defining a substantially planar flow path;

at least one mixing means for promoting the suspension of the particulate matter in the aqueous carrier;

the plurality of primary guide means connected consecutively in fluid communication by the at least one mixing means interposed between the primary guide means, defining a primary flow path;

each primary guide means being in fluid communication with at least one respective drop system forming a drop flow opening, each respective drop system including:

(a) at least two drop channels, a primary drop channel defining a drop flow path and a diversion drop channel; the primary drop channel being in fluid communication with the primary flow path via the drop flow opening;

(b) at least one diversion guide means for defining a flow path diverging from the drop flow path, and extending from the primary drop channel to the diversion drop channel, the diversion guide means and the diversion drop channel defining a diversion flow path;

the aqueous carrier and the particulate matter flowing along the primary flow path and for each primary guide means and respective drop system:

dividing into first, second, and third portions; the first portion continuing to flow along the primary flow path; the second and third portions flowing along the drop and diversion flow paths, respectively, of the respective drop system; the particulate matter in the first, second, and third portions being selected substantially according to the density of the particulate matter;

wherein each primary guide means is associated with a consecutively decreasing respective threshold density; and for each primary guide means and respective drop system:

(a) a majority of the particulate matter above the respective threshold density tends to be carried along the drop flow path of the respective drop system; and (b) a majority of the particulate matter below the respective threshold density tends to continue along the primary flow path; and a minority of the particulate matter both above and below the respective threshold density tends to be carried along the diversion flow path of the respective drop system;

whereby the particulate matter is substantially separated and concentrated according to density;

wherein said at least one primary guide means defines the planar flow path substantially orthogonally to a direction of a separation force acting upon the particulate matter; and wherein in each drop system said at least two drop channels define a flow path substantially in the direction of the separation force acting upon the particulate matter, and said at least one diversion guide means defines the flow path diverging from the drop flow path substantially orthogonally to the direction of the separation force acting upon the particulate matter; and wherein said separation force is gravity.

11. A particle separator for removing particulate matter of varying density from an aqueous carrier, comprising:

a plurality of primary guide means each defining a substantially planar flow path;

at least one mixing means for promoting the suspension of the particulate matter in the aqueous carrier;

the plurality of primary guide means connected consecutively in fluid communication by the at least one mixing means interposed between the primary guide means, defining a primary flow path;

each primary guide means being in fluid communication with at least one respective drop system forming a drop flow opening, each respective drop system including:

(a) at least two drop channels, a primary drop channel defining a drop flow path and a diversion drop channel; the primary drop channel being in fluid communication with the primary flow path via the droll flow opening;

(b) at least one diversion guide means for defining a flow path diverging from the drop flow path, and extending from the primary drop channel to the diversion drop channel, the diversion guide means and the diversion drop channel defining a diversion flow path;

the aqueous carrier and the particulate matter flowing along the primary flow path and for each primary guide means and respective drop system:

dividing into first, second, and third portions; the first portion continuing to flow along the primary flow path; the second and third portions flowing along the drop and diversion flow paths, respectively, of the respective drop system; the particulate matter in the first, second, and third portions being selected substantially according to the density of the particulate matter; wherein each primary guide means is associated with a consecutively decreasing respective threshold density; and for each primary guide means and respective drop system:

(a) a majority of the particulate matter above the respective threshold density tends to be carried along the drop flow path of the respective drop system; and (b) a majority of the particulate matter below the respective threshold density tends to continue along the primary flow path; and a minority of the particulate matter both above and below the respective threshold density tends to be carried along the diversion flow path of the respective drop system;

whereby the particulate matter is substantially separated and concentrated according to density;

wherein said at least one primary guide means defines the planar flow path substantially orthogonally to a direction of a separation force acting upon the particulate matter; and in each drop system said at least two drop channels define a flow path substantially in the direction of the separation force acting upon the particulate matter, and said at least one diversion guide means defines the flow path diverging from the drop flow path substantially orthogonally to the direction of the separation force acting upon the particulate matter; wherein said separation force is gravity; and the primary guide means and mixing means are provided by a plurality of concentric, annular steps.

* * * * *